US011622594B2

(12) United States Patent
Pratt et al.

(10) Patent No.: US 11,622,594 B2
(45) Date of Patent: Apr. 11, 2023

(54) FOOTWEAR HAVING MICRO ADJUSTABILITY

(71) Applicant: FAST IP, LLC, Lindon, UT (US)

(72) Inventors: Michael Pratt, Alpine, UT (US); Craig Cheney, Lindon, UT (US); Aislynn Edwards, Schenectady, NY (US)

(73) Assignee: FAST IP, LLC, Lindon, UT (US)

( * ) Notice: Subject to any disclaimer, the term of this patent is extended or adjusted under 35 U.S.C. 154(b) by 0 days.

(21) Appl. No.: 17/827,942

(22) Filed: May 30, 2022

(65) Prior Publication Data

US 2022/0287404 A1 Sep. 15, 2022

Related U.S. Application Data

(63) Continuation of application No. PCT/US2021/012537, filed on Jan. 7, 2021.

(60) Provisional application No. 62/957,815, filed on Jan. 7, 2020.

(51) Int. Cl.

| | |
|---|---|
| ***A43B 3/26*** | (2006.01) |
| ***A43B 13/14*** | (2006.01) |
| ***A43B 13/18*** | (2006.01) |

(52) U.S. Cl.

CPC ..... *A43B 3/26* (2013.01); *A43B 13/141* (2013.01); *A43B 13/183* (2013.01)

(58) Field of Classification Search

CPC ..... A43B 3/26; A43B 13/14; A43B 13/16
USPC ..... 36/97, 31
See application file for complete search history.

(56) References Cited

U.S. PATENT DOCUMENTS

| | | | | |
|---|---|---|---|---|
| 1,830,648 | A | 11/1931 | Engel | |
| 2,112,052 | A | 3/1938 | Smith | |
| 2,776,499 | A | 1/1957 | Guintini | |
| 3,541,708 | A | 11/1970 | Rosen | |
| 4,083,128 | A | 4/1978 | Rossman | |
| 4,813,157 | A | 3/1989 | Boisvert et al. | |
| 4,968,492 | A | 11/1990 | Rosen | |
| 5,036,604 | A | 8/1991 | Rosen | |
| 5,203,096 | A | 4/1993 | Rosen | |
| 5,241,762 | A | 9/1993 | Rosen | |
| 5,729,912 | A * | 3/1998 | Gutkowski | A43B 3/26 36/97 |
| 5,768,803 | A | 6/1998 | Levy | |
| 5,813,146 | A | 9/1998 | Gutkowski et al. | |
| 6,000,147 | A | 12/1999 | Kellerman | |
| 6,442,874 | B1 | 9/2002 | Long | |
| 6,450,510 | B1 | 9/2002 | Liu | |
| 6,920,707 | B1 | 7/2005 | Greene et al. | |

(Continued)

FOREIGN PATENT DOCUMENTS

| | | |
|---|---|---|
| CN | 203969442 U | 12/2014 |
| CN | 108851327 A | 11/2018 |

(Continued)

OTHER PUBLICATIONS

International Search Report and Written Opinion dated Mar. 9, 2021 in PCT International Patent Application No. PCT/US2021/012537.

(Continued)

*Primary Examiner* — Marie D Bays

(57) ABSTRACT

The present disclosure relates to an article of footwear with a sole structure having at least one adjustability pod configured to adjust at least one of a length and a width of the sole structure.

10 Claims, 5 Drawing Sheets

(56) References Cited

U.S. PATENT DOCUMENTS

| | | | | |
|---|---|---|---|---|
| 7,055,268 | B2 | 6/2006 | Ha | |
| 7,225,563 | B2 | 6/2007 | Chen et al. | |
| 7,392,604 | B2 | 7/2008 | Greene et al. | |
| 7,610,696 | B2 | 11/2009 | Davis | |
| 7,634,861 | B2 | 12/2009 | Kilgore | |
| 7,917,981 | B1 | 4/2011 | Lakic | |
| 9,301,571 | B2 | 4/2016 | Langvin | |
| 9,491,983 | B2 | 11/2016 | Rushbrook | |
| 9,808,045 | B2 | 11/2017 | Carlson et al. | |
| 10,159,302 | B2 | 12/2018 | Carlson et al. | |
| 10,499,707 | B2 | 12/2019 | Hobson et al. | |
| 10,588,382 | B2 | 3/2020 | Rushbrook | |
| 10,602,797 | B2 | 3/2020 | Lintaman | |
| 10,645,990 | B2 | 5/2020 | Rushbrook | |
| 10,667,579 | B2 | 6/2020 | Elder et al. | |
| 10,736,379 | B2 | 8/2020 | Cook et al. | |
| 10,765,170 | B2 | 9/2020 | Langvin et al. | |
| 10,765,175 | B2 | 9/2020 | Panian et al. | |
| 10,779,607 | B1 | 9/2020 | Chandel | |
| 10,827,800 | B2 | 11/2020 | Iannuzzi | |
| 10,827,803 | B2 | 11/2020 | Bell et al. | |
| 11,033,072 | B2 | 6/2021 | Oda | |
| 11,044,962 | B2 | 6/2021 | Cheung | |
| 2002/0178614 | A1 | 12/2002 | Issler | |
| 2004/0107605 | A1* | 6/2004 | Caeran | A43B 5/0435 36/97 |
| 2005/0055848 | A1* | 3/2005 | Miller | A43B 1/0072 36/97 |
| 2005/0060913 | A1 | 3/2005 | Chil et al. | |
| 2005/0115114 | A1* | 6/2005 | Miller | A43B 3/26 36/97 |
| 2006/0107552 | A1 | 5/2006 | Clark et al. | |
| 2006/0162191 | A1 | 7/2006 | Mason | |
| 2007/0251126 | A1* | 11/2007 | Tvoua | A43B 3/108 36/97 |
| 2008/0127518 | A1 | 6/2008 | Byrne et al. | |
| 2008/0178493 | A1 | 7/2008 | Scofield | |
| 2009/0172972 | A1 | 7/2009 | Rosen | |
| 2011/0047826 | A1* | 3/2011 | Rosen | A43B 23/07 36/97 |
| 2011/0185600 | A1 | 8/2011 | Malek | |
| 2013/0152426 | A1 | 6/2013 | Lederer | |
| 2013/0219744 | A1 | 8/2013 | Case et al. | |
| 2013/0333244 | A1* | 12/2013 | Rosen | A43B 3/26 36/97 |
| 2013/0333246 | A1* | 12/2013 | Weller | A43B 3/26 36/103 |
| 2014/0041256 | A1 | 2/2014 | Espinola | |
| 2014/0123516 | A1 | 5/2014 | Cressman et al. | |
| 2014/0182167 | A1 | 7/2014 | James et al. | |
| 2014/0215770 | A1 | 8/2014 | Levesque et al. | |
| 2014/0237850 | A1 | 8/2014 | Hull | |
| 2014/0259752 | A1 | 9/2014 | Feldman | |
| 2015/0366288 | A1 | 12/2015 | Miller | |
| 2017/0056754 | A1 | 3/2017 | Yu et al. | |
| 2017/0188655 | A1* | 7/2017 | Carlson | A43B 13/14 |
| 2017/0280823 | A1* | 10/2017 | Langvin | A43B 9/02 |
| 2018/0135213 | A1 | 5/2018 | Bell et al. | |
| 2018/0242694 | A1 | 8/2018 | Webster | |
| 2018/0255872 | A1 | 9/2018 | Manasiya | |
| 2018/0325216 | A1 | 11/2018 | Toronjo | |
| 2019/0297988 | A1 | 10/2019 | Oden et al. | |
| 2019/0380430 | A1 | 12/2019 | Seid | |
| 2020/0008516 | A1 | 1/2020 | Chan et al. | |
| 2020/0046080 | A1 | 2/2020 | Burns et al. | |
| 2020/0253334 | A1 | 8/2020 | Elder et al. | |
| 2020/0352282 | A1 | 11/2020 | Drake | |
| 2020/0367604 | A1 | 11/2020 | Langvin et al. | |
| 2020/0375301 | A1 | 12/2020 | Cheung | |
| 2021/0037912 | A1 | 2/2021 | Spencer | |
| 2021/0204639 | A1 | 7/2021 | Yang | |
| 2021/0219651 | A1 | 7/2021 | Rushbrook et al. | |
| 2021/0227925 | A1 | 7/2021 | Kim | |

FOREIGN PATENT DOCUMENTS

| | | | |
|---|---|---|---|
| CN | 109549280 | A | 4/2019 |
| GB | 2432295 | A | 5/2007 |
| KR | 100540394 | B1 | 12/2005 |
| WO | 2006106612 | A2 | 10/2006 |

OTHER PUBLICATIONS

International Search Report and Written Opinion dated Mar. 9, 2021 for PCT/US2021/012537 filed Jan. 7, 2021, 9 pages.

* cited by examiner

FOOTWEAR HAVING MICRO ADJUSTABILITY

CROSS-REFERENCE TO RELATED APPLICATION

This application is a continuation of, claims priority to and the benefit of PCT Serial No. PCT/US21/12537 filed Jan. 7, 2021 and entitled "FOOTWEAR HAVING MICRO ADJUSTABILITY." PCT Serial No. PCT/US21/12537 claims the benefit of U.S. Provisional Patent Application No. 62/957,815, filed Jan. 7, 2020 and entitled "FOOTWEAR HAVING MICRO ADJUSTABILITY." All of the aforementioned applications are incorporated herein by reference in their entireties.

FIELD

The present disclosure relates to footwear having micro adjustability.

BACKGROUND

Whether due to growth, pregnancy, injury, swelling or activity (e.g., walking versus running), to name a few, the desired length and/or width of footwear may change over time, and do so before footwear is otherwise "worn out." The present disclosure addresses this need.

SUMMARY

Example embodiments of the present disclosure comprise an article of footwear comprising a sole structure coupled to an upper, wherein the sole structure comprises an adjustability pod configured to adjust at least one of a length and a width of the sole structure, wherein the sole structure comprises an open configuration and a closed configuration, and wherein a dimension of the sole structure is greater in the open configuration than it is in the closed configuration.

In accordance with example embodiments, the adjustability pod comprises a spring and a threaded member extending along an axis through the spring, wherein rotation of the threaded member relative to the spring adjusts the dimension of the sole structure, and wherein the dimension is along the axis.

In accordance with example embodiments, the adjustability pod comprises a scissor lift and a threaded member extending along an axis through the scissor lift, wherein rotation of the threaded member relative to the scissor lift adjusts the dimension of the sole structure, and wherein the dimension is orthogonal to the axis.

In accordance with example embodiments, the sole structure comprises a plurality of adjustability pods collectively forming an adjustability pod skeleton.

In accordance with example embodiments, the plurality of adjustability pods are interconnected by a plurality of flexible ribs configured to permit relative movement between the plurality of adjustability pods. In accordance with example embodiments, a perimeter of the adjustability pod skeleton is discontinuous between the plurality of adjustability pods to permit relative movement between the plurality of adjustability pods.

In accordance with example embodiments, the adjustability pod skeleton is embedded all or partially within the sole structure. In accordance with example embodiments, the sole structure is structurally or compositionally configured to permit relative movement between the plurality of adjustability pods.

In accordance with example embodiments, the adjustability pod comprises a threaded member. In accordance with example embodiments, an end of the threaded member is accessible through a sidewall of the sole structure. In accordance with example embodiments, the article of footwear further comprising a shoelace having an aglet key configured to engage with and rotate the end of the threaded member.

BRIEF DESCRIPTION OF THE DRAWINGS

The accompanying drawings may provide a further understanding of example embodiments of the present disclosure and are incorporated in, and constitute a part of, this specification. In the accompanying drawings, only one shoe (either a left shoe or a right shoe) may be illustrated, however, it should be understood that in such instances, the illustrated shoe may be mirror-imaged so as to be the other shoe. The use of like reference numerals throughout the accompanying drawings is for convenience only, and should not be construed as implying that any of the illustrated embodiments are equivalent. The accompanying drawings are for purposes of illustration and not of limitation.

DETAILED DESCRIPTION

Figure 1A:
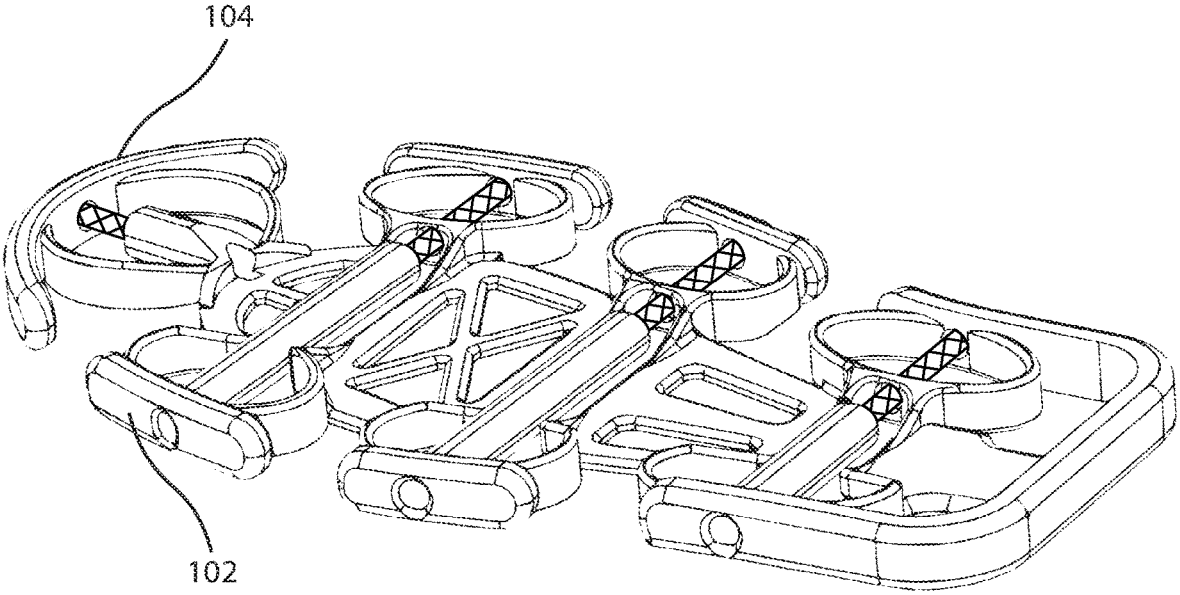
FIGS. 1A and 1B illustrate a top perspective view and a bottom perspective view, respectively, of an example embodiment of an adjustability pod skeleton comprising a plurality of adjustability pods, in accordance with the present disclosure.

Example embodiments of the present disclosure are described in sufficient detail in this detailed description to enable persons having ordinary skill in the relevant art to practice the present disclosure, however, it should be understood that other embodiments may be realized and that mechanical and chemical changes may be made without departing from the spirit or scope of the present disclosure. Thus, this detailed description is for purposes of illustration and not of limitation.

For example, unless the context dictates otherwise, example embodiments described herein may be combined with other embodiments described herein. Similarly, references to "example embodiment," "example embodiments" and the like indicate that the embodiment(s) described may comprise a particular feature, structure, or characteristic, but every embodiment may not necessarily comprise the particular feature, structure, or characteristic. Moreover, such references may not necessarily refer to the same embodiment(s). Any reference to singular includes plural embodiments, and any reference to plural includes singular embodiments.

Any reference to coupled, connected, attached or the like may be temporary or permanent, removeable or not, non-integral or integral, partial or full, and may be facilitated by one or more of adhesives, stitches, hook and loop fasteners, buttons, clips, grommets, zippers and other means known in the art or hereinafter developed.

As used herein, the transitional term "comprising", which is synonymous with "including," "containing," or "characterized by," is inclusive or open-ended and does not exclude additional, unrecited elements or method steps. The transitional phrase "consisting of" excludes any element, step, or ingredient not specified in the claim. The transitional phrase "consisting essentially of" limits the scope of a claim to the specified materials or steps "and those that do not materially affect the basic and novel characteristic(s)" of the claimed invention.

No claim limitation is intended to invoke 35 U.S.C. 112(f) or pre-AIA 35 U.S.C. 112, sixth paragraph or the like unless it explicitly uses the term "means" and includes functional language.

In describing example embodiments of the footwear having micro adjustability, certain directional terms may be used. By way of example, terms such as "right," "left," "medial," "lateral," "front," "back," "forward," "backward," "rearward," "top," "bottom," "upper," "lower," "up," "down," and the like may be used to describe example embodiments of the footwear having micro adjustability. These terms should be given meaning according to the manner in which the footwear having micro adjustability is most typically designed for use, with the footwear having micro adjustability on a user's foot and with the user's shod foot disposed on or ready for placement on an underlying surface. Thus, these directions may be understood relative to the footwear having micro adjustability in such use. Similarly, as the footwear having micro adjustability is intended primarily for use as footwear, terms such as "inner," "inward," "outer," "outward," "innermost," "outermost," "inside," "outside," and the like should be understood in reference to the footwear having micro adjustability's intended use, such that inner, inward, innermost, inside, and the like signify relatively closer to the user's foot, and outer, outward, outermost, outside, and the like signify relatively farther from the user's foot when the footwear having micro adjustability is being used for its intended purpose. Notwithstanding the foregoing, if the foregoing definitional guidance is contradicted by an individual use herein of any of the foregoing terms, the term should be understood and read according to the definition that gives life and meaning to the particular instance of the term.

As used herein, a "footwear" refers to an athleisure shoe, a casual shoe, a formal shoe, a dress shoe, a heel, a sports/athletic shoe (e.g., a tennis shoe, a golf shoe, a bowling shoe, a running shoe, a basketball shoe, a soccer shoe, a ballet shoe, etc.), a walking shoe, a sandal, a flip flop, a boot, or other suitable type of shoe. Additionally, footwear can be sized and configured to be worn by men, women, or children.

In accordance with example embodiments, the present disclosure provides for an article of footwear comprising a sole structure coupled to an upper, wherein the sole structure comprises an adjustability pod (e.g., a tensioner) configured to adjust at least one of a length and a width of the sole structure. In example embodiments, the sole structure comprises an open configuration and a closed configuration wherein a dimension (e.g., length, width, perimeter) of the sole structure is greater in the open configuration than it is in the closed configuration.

As used herein, "sole structure" refers to an outsole or portions thereof, a midsole or portions thereof, an insole or portions thereof, a wedge or portions thereof, or other suitable structure disposed between and/or adjacent to the foregoing parts of a shoe.

Figure 1B:
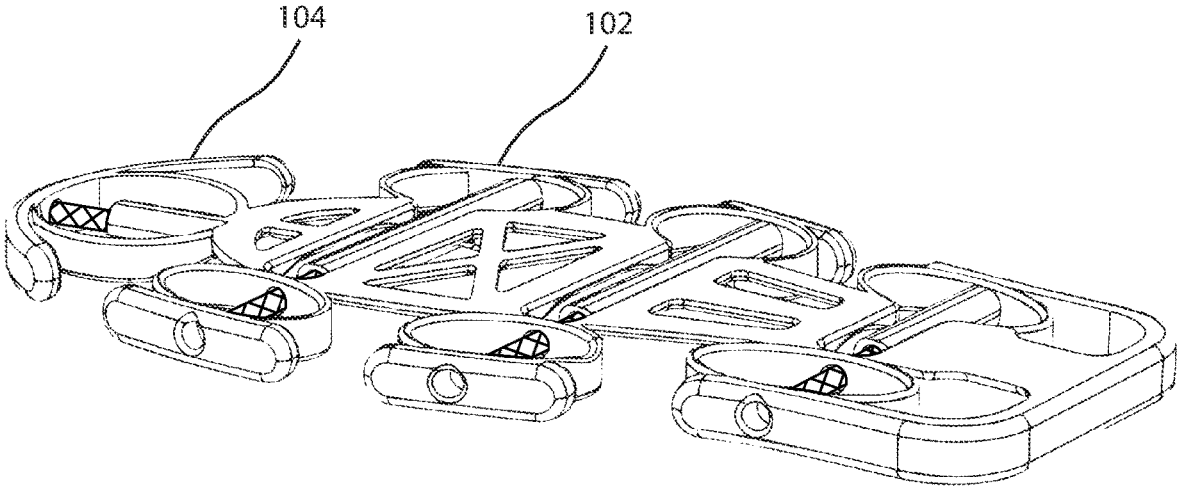

With reference to FIGS. 1A and 1B, example embodiments of the present disclosure comprise a shoe having an adjustable (i.e., increased and/or decreased) width. Adjustment can be provided by one or more width adjustability pods 102 extending all or partially between a lateral perimeter (or non-perimeter portion) and a medial perimeter (or non-perimeter portion) of the sole portion. A plurality of width adjustability pods 102 (e.g., 2, 3, 4 or more) can be spaced along a length of the shoe (e.g., just in forefoot, just in heel, in both forefoot and heel). Thus, an adjustability pod skeleton (as descried below) can be located exclusively in a forefoot, exclusively in a heel, or in both a forefoot and a heel.

Example embodiments of the present disclosure comprise a shoe having an adjustable (i.e., increased and/or decreased) length. Adjustment can be provided by one or more length adjustability pods 104 extending all or partially between a front perimeter (or non-perimeter portion) and a back perimeter (or non-perimeter portion) of the shoe. A plurality of length adjustability pods 104 (e.g., 2, 3, 4 or more) can be spaced along a width of the shoe. While it can be, in example embodiments, length adjustment is not perpendicular to width adjustment. Additionally, a single adjustability pod can be oriented at an angle to provide for simultaneous width and length adjustment, with the angle of orientation determining the relative amounts of width and length adjustment.

Figure 2A:
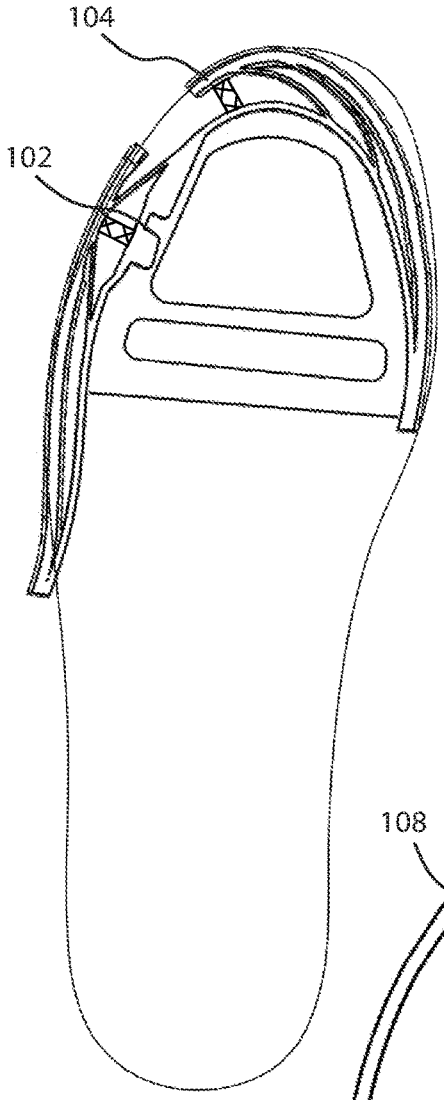
FIGS. 2A-2C illustrate example embodiments of adjustability pod skeletons, in accordance with the present disclosure.

Additional embodiments of a width adjustability pod 102 and a length adjustability pod 104 are disclosed with reference to FIG. 2A. Such embodiments may comprise an arch extending from a rib (as described below) on a side of the arch and being coupled to the rib with a threaded member on the other side of the arch. The arch can extend along a width and a length of the sole structure to provide for simultaneous width and length adjustment.

Figure 2B:
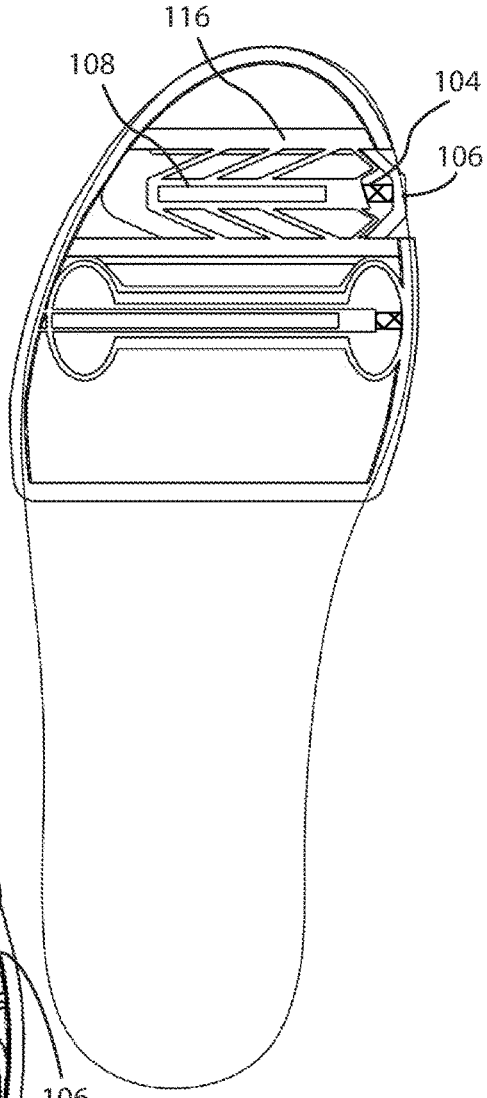
Figure 2C:
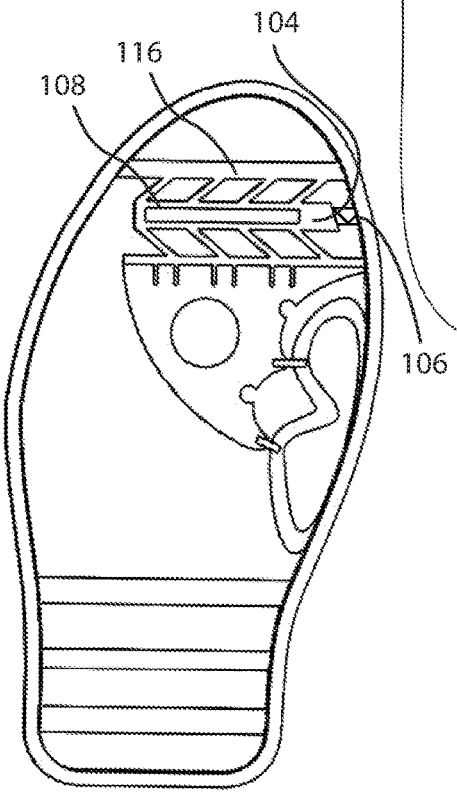

While one or more length adjustability pods can extend all or partially between a front perimeter (or non-perimeter portion) and a back perimeter (or non-perimeter portion), with reference to FIGS. 2B and 2C, adjustment can also be provided by one or more length adjustability pods 104 extending all or partially between a lateral perimeter (or non-perimeter portion) and a medial perimeter (or non-perimeter portion) of the shoe. In such embodiments, a length adjustability pod comprises one or more expandable wings (e.g., a scissor lift, as described below).

Figure 3A:
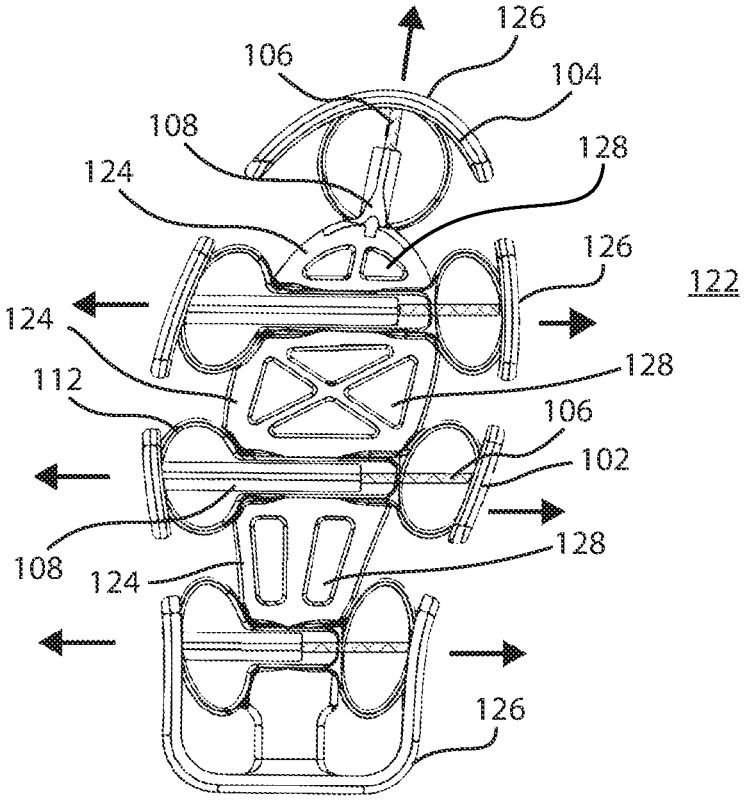
FIGS. 3A and 3B illustrate open and closed configurations, respectively, of an example embodiment of an adjustability pod skeleton, in accordance with the present disclosure.
Figure 3B:
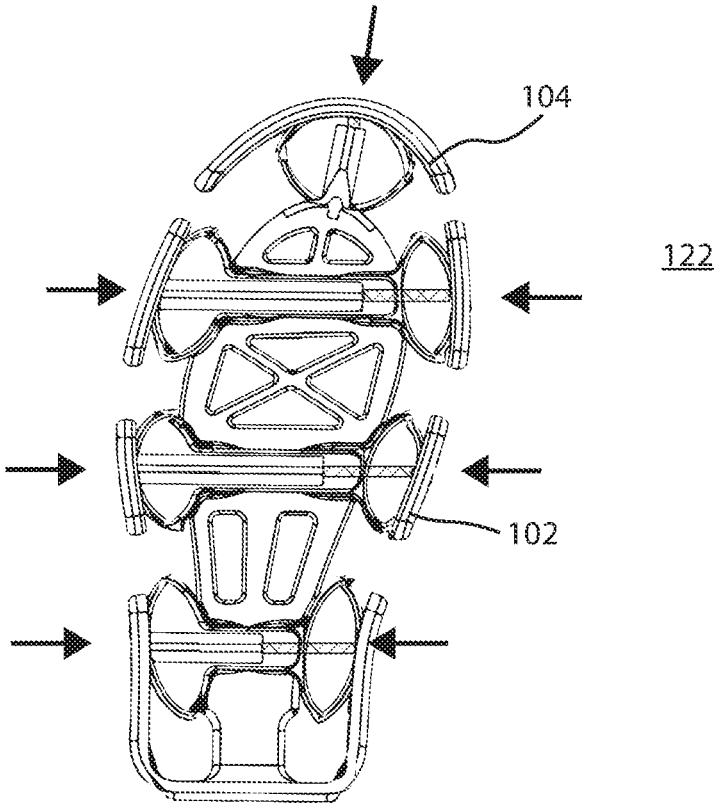

With reference now to FIGS. 3A and 3B, whether a width adjustability pod 102 or a length adjustability pod 104, an adjustability pod can comprise a threaded engagement between a threaded member 106 (e.g., a screw or bolt, which can be rigid or configured to be resiliently deformable) and a female member 108 corresponding the threaded member 106. In other embodiments, an adjustability pod can comprise a ratchet, clamp, cable, elastic or other engagement between a first portion and a second portion. In this regard, footwear having micro adjustability as disclosed herein may have an infinite number of micro adjustments, not a predetermined, finite number of adjustments.

In accordance with example embodiments, an adjustability pod 102/104 can comprise an adjustability pod skirt 126, the adjustability pod skirt 126 being configured to distribute a force exerted by an adjustability pod 102/104 equally across a portion of the sole structure.

In accordance with example embodiments, a width adjustability pod 102 (or a length adjustability pod 104) can comprise a spring 112 and a threaded member 106 extending along an axis through the spring 112. In such embodiments, rotation of the threaded member 106 relative to a female member 108 coupled to the spring 112 can adjust a dimension of the sole structure along or parallel to the axis of threaded member 106. Spring 112 can be comprised of one or a plurality of a leaf spring, wave spring, coil spring, or any other spring known in the art or hereinafter developed. Alternatively, spring 112 can be comprised of a block of material configured to be resiliently deformable.

In accordance with example embodiments, and with momentary reference back to FIGS. 2B and 2C, a length adjustability pod 104 (or a width adjustability pod 102) can comprise a scissor lift 116 and a threaded member 106 extending along an axis through the scissor lift 116. In such embodiments, rotation of the threaded member 106 relative a female member 108 coupled to the scissor lift 116 can adjust a dimension of the sole structure orthogonal to the axis of threaded member 106.

An adjustability pod can comprise one or more visual, tactile or audible indicators of adjustment (e.g., a click every 2 mm or a mark corresponding to 2 mm).

Turning now back to FIGS. 3A and 3B, in accordance with example embodiments, a plurality of width adjustability pods 102 and/or length adjustability pods 104 can (e.g., be interconnected to) collectively form an adjustability pod skeleton 122. For example, a plurality of adjustability pods can be interconnected and/or a unitary structure (e.g., formed from a single mold).

In accordance with example embodiments, the plurality of adjustability pods 102/104 are interconnected by, and/or interconnected and/or a unitary structure (e.g., formed from a single mold) with, a plurality of flexible ribs 124 configured to permit relative movement between the plurality of adjustability pods 102/104. A rib 124 can comprise one or more apertures or voids 128 extending therethrough, for example 1, 2, 3, 4 or more. A rib 124 can be coplanar with only a bottom surface of an adjustability pod 102/104, only a top surface of an adjustability pod 102/104, or both bottom and top surfaces of an adjustability pod 102/104. A rib 124 can be comprised of a material less rigid than that of an adjacent adjustability pod 102/104. Stated differently, a rib 124 can be configured to be more deformable than an adjacent adjustability pod 102/104.

In accordance with example embodiments, a perimeter of the adjustability pod skeleton 122 (e.g., as defined a plurality of adjustability pod skirts 126) is discontinuous between the plurality of adjustability pods 102/104 to permit relative movement between the plurality of adjustability pods 102/104. That is, in accordance with example embodiments, an adjustability pod 102/104 extends perimetrically further from a center point than a rib 124.

Each of a width adjustability pod 102, a length adjustability pod 104 and an adjustability pod skeleton 122 can be rigid or semi-rigid (e.g., to flexibly accommodate regular motion of a foot). Such a material may comprise one or more of nylon, acetal homopolymer/polyoxymethylene, aluminum, graphite, thermoplastic polyurethane (TPU), thermoplastic copolyester elastomer (TPC-ET), polypropylene, acrylic resin, rubber, titanium, acrylonitrile butadiene styrene (ABS), and polycarbonate. Such a material may comprise a shape-memory material.

Figure 4A:
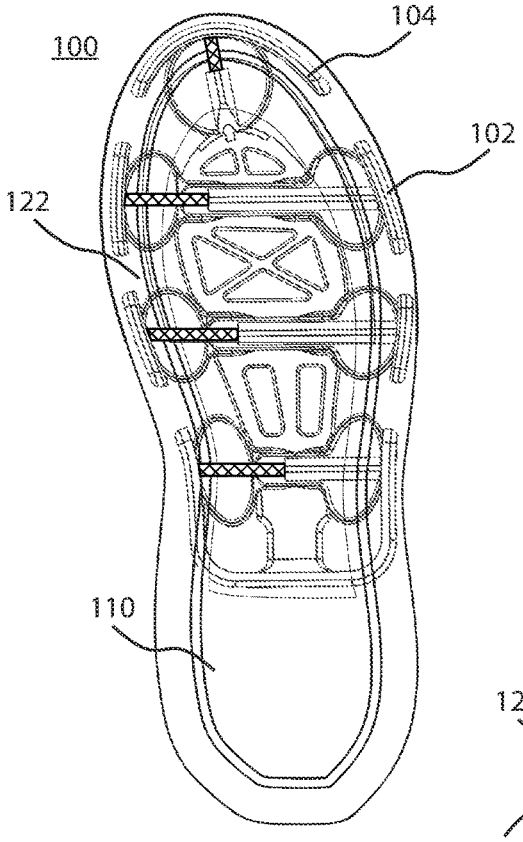
FIGS. 4A, 4B and 4C illustrate a top perspective view, a side perspective view and a rear perspective view, respectively, of an example embodiment of an adjustability pod skeleton embedded within a sole structure, in accordance with the present disclosure.
Figure 4C:
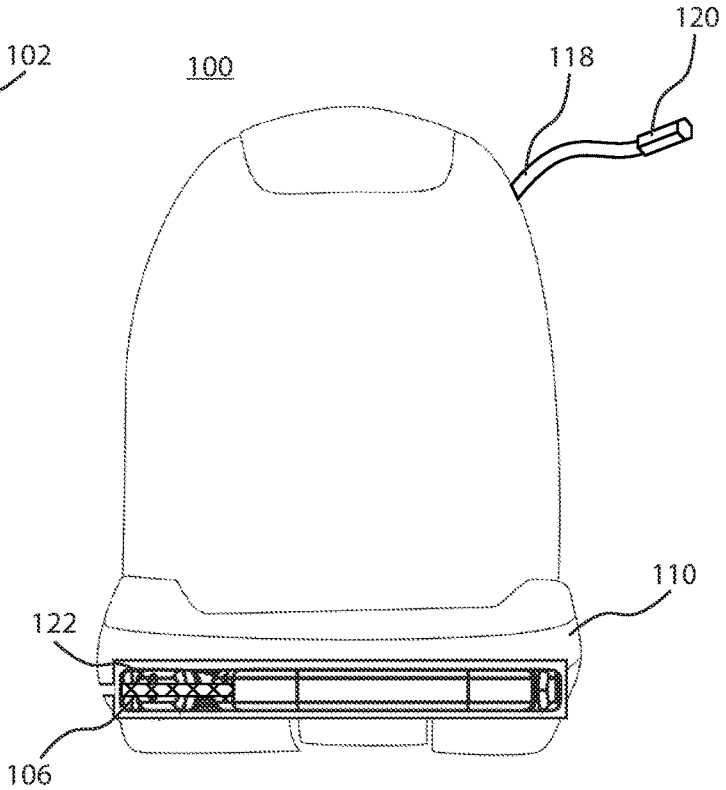
Figure 4B:
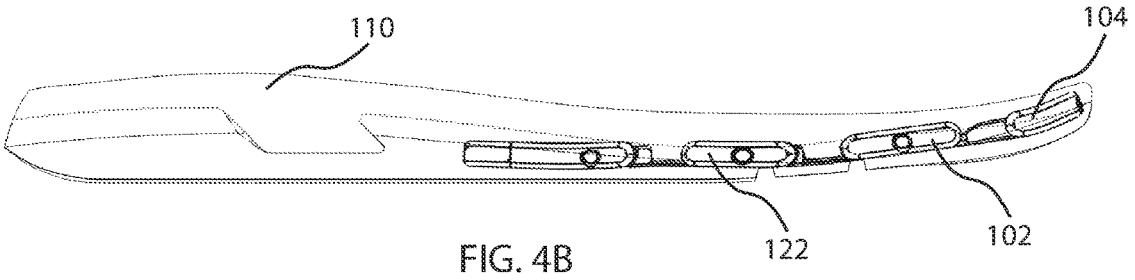

With reference now to FIGS. 4A, 4B and 4C, in accordance with example embodiments, each of a width adjustability pod 102, a length adjustability pod 104 and an adjustability pod skeleton 122 can be embedded or otherwise located all or partially within, or otherwise coupled to, a sole structure 110 of an article of footwear 100. In this regard, and in accordance with example embodiments, the sole structure is structurally (e.g., configured to have one or more apertures or voids) or compositionally (e.g., configured to be resiliently deformable) configured to permit relative movement between the plurality of adjustability pods, as described below. In some embodiments, a sole structure is selectively coupled to a tensioner skeleton at distinct points to accommodate transfer of changes to the dimensions of individual adjustability pods to the sole structure.

In some embodiments, a sole structure comprises a perimetric channel surrounding a perimeter of an adjustability pod skeleton to accommodate changes to the dimensions of individual adjustability pods.

Additionally, a width adjustability pod 102 and/or a length adjustability pod 104 can comprise an expanded portion for anchoring the width adjustability pod 102 and/or the length adjustability pod 104 in the sole structure 110.

In accordance with example embodiments, and with continued reference to FIG. 4C, an adjustability pod can comprise a threaded member 106, an end of which is accessible through a sidewall of the sole structure 110. In accordance with example embodiments, the article of footwear 100 further comprising a shoelace 118 having an aglet key 120 (e.g., a hex key, a star key, or a key having a distinctive shape) configured to engage with and rotate the end of the threaded member 106. In this regard, the aglet key 120 can be comprised of a metal or a polymer with a hardness sufficient to retain its shape after used repeatedly to apply a torque to the end of the threaded member 106. While the illustrated embodiments contemplate the end of the threaded member 106 being accessible through a sidewall of the sole structure, the end of the threaded member 106 may alternatively be accessible through an upper or lower surface of the sole structure.

Figure 5:
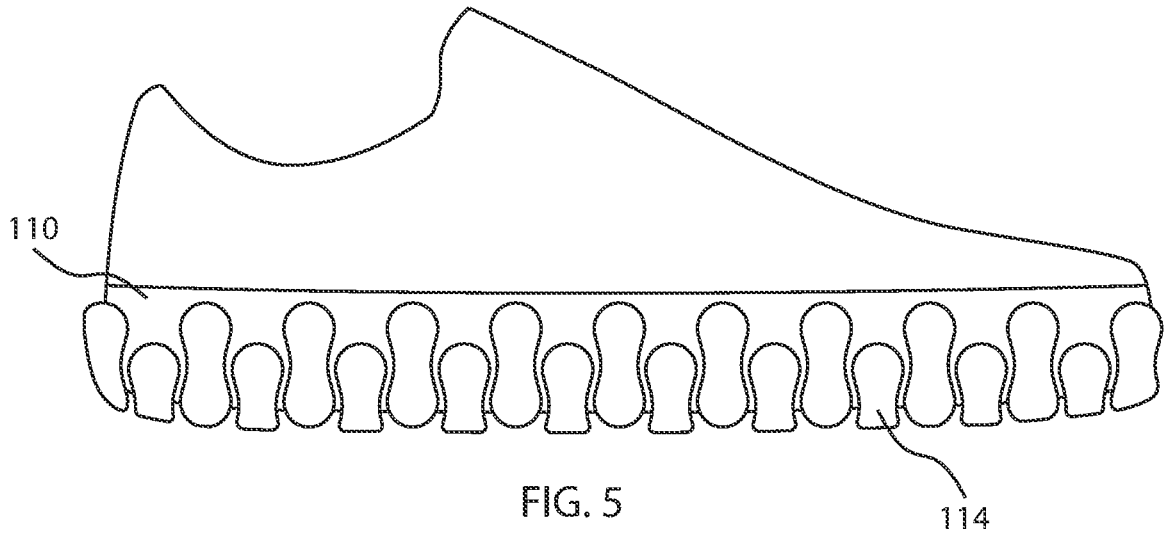
FIG. 5 illustrates an example embodiment of a sole structure having a plurality of sidewall adjustability pods, in accordance with the present disclosure.

With reference to FIG. 5, a sole structure 110 of a shoe can comprise a plurality of sidewall adjustability pods 114, to provide for length and/or width adjustability of the shoe. For example, a sidewall adjustability pod 114 can be rotatably coupled to a perimeter of a sole structure 110 at or near the center of the sidewall adjustability pod 114, such that motion of a foot can actuate the sidewall adjustability pod 114 outward above its center to accommodate the foot. In example embodiments, a sidewall adjustability pod 114 is biased inward above its center.

An article of footwear as described herein can have an open configuration (e.g., FIG. 3A), in which the shoe has a larger perimeter, length and/or width than in a closed configuration (e.g., FIG. 3B).

An article of footwear as described herein can have a closed configuration (e.g., FIG. 3B), in which the shoe has a smaller perimeter, length and/or width than in an open configuration (e.g., FIG. 3A).

In some embodiments, the spaces between adjustability pod skeleton parts are merely apertures or voids, while in other embodiments, the spaces between adjustability pod skeleton parts are comprised of a filler material or structure, for example, a material less dense that the material defining the spaces between adjustability pod skeleton parts, an air pocket, a spring, or one or a plurality of ribs (e.g., organized in a lattice or honeycomb structure and/or an auxetic pattern). The filler material or structure can bias, at least in part, the shoe from a closed to an open configuration, or, alternatively, from an open to a closed configuration.

In this regard, in some embodiments, the shoe is biased in an open configuration, while in other embodiments, the shoe is biased in a closed configuration. In still other embodiments, the shoe is bi-stable (i.e., in both an open configuration and a closed configuration).

In some embodiments, securement in and/or transition between, open and closed configurations, which may be incremental, is facilitated by one or more of a belt, ratchet (e.g., a zip-tie mechanism), cord (e.g., extending through a sole structure out of the rear of the shoe), strap with hook and loop fasteners, or the like, in some embodiments with a quick release, surrounding all or a portion of the sole structure. For example, a strap can be belted through apertures in a perimeter of a sole structure. In other embodiments, securement in and/or transition between, open and closed configurations, is facilitated by an air bladder. In still other embodiments, securement in and/or transition between, open and closed configurations, is facilitated by a cord or the like extending through one or more spaces between adjustability pod skeleton parts, which may further be driven by a cam system, e.g., including an eccentric wheel. In yet other embodiments, securement in and/or transition between, open and closed configurations, is facilitated by an eccentric wedge element positioned in one or more apertures that, when turned, transitions the aperture(s) from a closed to an open configuration, or, alternatively, from an open to a closed configuration. Moreover, a shoe in accordance with the present disclosure may comprise one or more visual, tactile or audible indicators of adjustment (e.g., a click every 2 mm or a mark corresponding to 2 mm). In connection with example embodiments, the sole structure may have a surrounding bumper surrounding all of a portion of the sole structure, the bumper having one or more folds, pleats or baffles, or overlapping or telescoping portions, to accommodate length and/or width adjustability of the shoe.

To accommodate adjustment to length and/or width of the sole structure, an upper coupled to the sole structure may be comprised of an expandable material (e.g., a knit, stretch or elastic material), comprise one or more gussets or gores, and/or comprise overlapping or folding panels. Additionally, coupling of an upper to the sole structure may not be at the spaces between adjustability pod skeleton parts (regardless of whether comprising a filler material or structure as described herein). For example, an adhesive may be selectively applied (e.g., screen printed) to the sole structure only around the spaces between adjustability pod skeleton parts (i.e., not covering the spaces between adjustability pod skeleton parts). Additionally, a footbed of a shoe in accordance with the present disclosure may comprise one or more features to accommodate length and/or width adjustability of the shoe, for example, one or more expandable/collapsible apertures, gussets, gores, overlapping or folding panels, or the like. Additionally, the sole structure may be covered with a hardened material to provide protection from objects extending through the apertures and/or to provide comfort relative to the apertures.

It will be apparent to those skilled in the art that various modifications and variations can be made in the present disclosure without departing from the spirit or scope of the disclosure. Thus, it is intended that the embodiments described herein cover the modifications and variations of this disclosure provided they come within the scope of the appended claims and their equivalents.

Numerous characteristics and advantages have been set forth in the preceding description, including various alternatives together with details of the structure and function of the devices and/or methods. The disclosure is intended as illustrative only and as such is not intended to be exhaustive. It will be evident to those skilled in the art that various modifications can be made, especially in matters of structure, materials, elements, components, shape, size and arrangement of parts including combinations within the principles of the invention, to the full extent indicated by the broad, general meaning of the terms in which the appended claims are expressed. To the extent that these various modifications do not depart from the spirit and scope of the appended claims, they are intended to be encompassed therein.

We claim:

1. An article of footwear comprising:

a sole structure coupled to an upper, wherein the sole structure comprises an adjustability pod configured to adjust at least one of a length and a width of the sole structure, wherein the sole structure comprises an open configuration and a closed configuration, and wherein a dimension of the sole structure is greater in the open configuration than it is in the closed configuration, wherein the adjustability pod comprises a scissor lift and a threaded member extending along an axis through the scissor lift, wherein rotation of the threaded member relative to the scissor lift adjusts the dimension of the sole structure, and wherein the dimension is orthogonal to the axis.

2. An article of footwear comprising:

a sole structure coupled to an upper, wherein the sole structure comprises an adjustability pod configured to adjust at least one of a length and a width of the sole structure, wherein the sole structure comprises an open configuration and a closed configuration, and wherein a dimension of the sole structure is greater in the open configuration than it is in the closed configuration, wherein the sole structure comprises a plurality of adjustability pods collectively forming an adjustability pod skeleton, wherein the plurality of adjustability pods are interconnected by a plurality of flexible ribs configured to permit relative movement between the plurality of adjustability pods.

3. An article of footwear comprising:

a sole structure coupled to an upper, a plurality of adjustability pods, wherein each of the plurality of adjustability pods is configured to adjust at least one of a length and a width of the sole structure, wherein the plurality of adjustability pods are interconnected by a plurality of flexible ribs to form a adjustability pod skeleton, and wherein the adjustability pod skeleton is embedded within the sole structure.

4. The article of footwear of claim 3, wherein the adjustability pod comprises a threaded member.

5. The article of footwear of claim 3, wherein the threaded member is configured to be resiliently deformable.

6. The article of footwear of claim 3, wherein an end of the threaded member is accessible through a sidewall of the sole structure.

7. The article of footwear of claim 3, further comprising a shoelace having an aglet key configured to engage with and rotate the end of the threaded member.

8. The article of footwear of claim 3, wherein at least one of the plurality of adjustability pods is configured to simultaneously adjust both the length and the width of the sole structure.

9. The article of footwear of claim 3, wherein at least one of the plurality of flexible ribs comprises an aperture or void extending therethrough.

10. The article of footwear of claim 3, wherein the plurality of flexible ribs are configured to be more deformable than the plurality of adjustability pods.

* * * * *